US006257164B1

(12) United States Patent
Carey, II

(10) Patent No.: US 6,257,164 B1
(45) Date of Patent: Jul. 10, 2001

(54) DOCK JOINT STRUCTURE

(75) Inventor: Jay F. Carey, II, Follansbee, WV (US)

(73) Assignee: The Louis Berkman Company, Steubenville, OH (US)

( * ) Notice: Subject to any disclaimer, the term of this patent is extended or adjusted under 35 U.S.C. 154(b) by 0 days.

(21) Appl. No.: 09/425,916

(22) Filed: Oct. 25, 1999

(51) Int. Cl.[7] ..... B63B 35/44
(52) U.S. Cl. ..... 114/263
(58) Field of Search ..... 405/219, 118; 114/263, 264, 265, 266; 14/2.6, 27, 28, 29, 30, 73.5, 74, 78

(56) References Cited

U.S. PATENT DOCUMENTS 3,667,192 * 6/1972 Sewell ..... 52/213
4,488,833 * 12/1984 Perry et al. ..... 404/35
4,572,702 * 2/1986 Bone ..... 404/65
4,683,833 8/1987 Meriwether .
4,799,445 1/1989 Meriwether .
4,938,629 * 7/1990 Boudrias ..... 405/205
4,974,538 12/1990 Meriwether .
5,199,371 4/1993 Meriwether .
5,281,055 * 1/1994 Neitzke et al. ..... 405/219

* cited by examiner

*Primary Examiner*—S. Joseph Morano
*Assistant Examiner*—Ajay Vasudeva
(74) *Attorney, Agent, or Firm*—Vickers, Daniels & Young

(57) ABSTRACT

A dock bridge to overlie a gap between two connected dock sections. The dock bridge includes two connector plates and a flexible material connected between the two connector plates. Each of the connector plates is made of a corrosion resistant material and the flexible material is made of a water resistant material. The flexible material includes a plurality of ribs positioned in a substantially parallel orientation and lying substantially parallel to the longitudinal axis of the dock bridge.

22 Claims, 6 Drawing Sheets

DOCK JOINT STRUCTURE

The present invention relates to the art of floating docks and, more particularly, to an improved dock structure for a floating dock.

BACKGROUND OF THE INVENTION

Floating dock systems presently in use are generally comprised of two or more individual dock structures secured to one another and maintained buoyant by underlying sealed metal drums, styrofoam floats, hollow or foam-filled plastic floats and the like. These dock structures are generally connected together by a hinge to permit relative vertical pivoting movement therebetween as dictated by the momentary surface wave conditions of the body of water on which the dock structures are floating. Examples of floating docks using hollow or plastic float drums are disclosed in U.S. Pat. Nos. 4,683,833; 4,799,445; 4,974,538; and 5,199,371, all of which are incorporated herein by reference.

As disclosed in these patents, a floating dock may be comprised of a plurality of dock sections suitably interconnected to provide a floating dock assembly. The dock structure for each dock section typically includes a rectangular frame having side and end members of wood or metal, and decking in the form of wooden deck boards. In many dock systems, the dock structures are interconnected together by simply threading a suitably diametered metal pipe or rod either through a series of sturdy eye bolts secured in an aligned relation to the adjoining opposed vertical faces of the dock sections or through aligned bearing openings in pairs of metal bearing plates secured to the vertical sides of the respective adjoining dock sections and projecting outwardly therefrom. In such arrangements, a sizeable gap opening is left between the adjoining dock sections extending across the full width of the deck planking on the dock sections. These gap openings in the dock system create a crude and unsightly appearance in the dock system which can detract from the appearance of the floating dock system. In addition, the gap openings between the dock sections require care by a person walking on the decks to avoid having objects caught between the gap openings.

Many of the problems associated with gap openings are overcome by the hinge connecting structure disclosed in U.S. Pat. No. 4,683,833. The disclosed hinge connecter is designed to close the gap between the spaced dock sections and is positioned to lie approximately level with the top of the dock section. Although the hinge connecter overcomes many of the problems associated with gaps between docks sections, there are many existing dock systems which do not and cannot incorporate the improved hinge structure. In addition, the retro fitting of existing dock structures with the improved hinge is in many cases cost prohibitive and/or cannot be connected to a particular type of dock system. Furthermore, the positioning of the hinge approximately level with the top of the dock section still requires a person walking on the deck to be aware of the existence of the hinge when the dock sections pivotally move with respect to one another.

In view of the present problems of existing dock systems, there is a need for a structure which eliminates the problems associated with the gaps located between dock structures.

SUMMARY OF THE INVENTION

In accordance with the present invention, a dock structure is provided for a floating dock system which advantageously overcomes the forgoing problems in connection with the existence of gaps between adjacently positioned dock structures. More particularly, a dock bridge in accordance with the present invention interconnects adjacently positioned dock structures and closes or covers the gap between the dock sections thereby forming a continuous deck surface therebetween. In one embodiment, the dock bridge is secured to one or more of the decking boards on the top of each of the dock structures to secure the dock bridge in place relative to the adjacently positioned dock structures. In another preferred embodiment, at least one end of the dock bridge is secured to a side of a dock section.

In accordance with another aspect of the present invention, the dock bridge includes a flexible material which at least partially spans the gap between the dock sections. The flexible material is designed to flex as the two adjacently positioned dock systems move with respect to one another. The flexible material is also designed to be durable enough to maintain its integrity over time as the adjacently positioned dock structures move. Preferably, the flexible material is a water resistant material which resists degradation in the presence of fresh and/or salt water. In one preferred embodiment, the flexible material is a nylon, plastic and/or rubber material. In accordance with another preferred embodiment, the flexible material completely spans the gap between the adjacently positioned dock structures.

In accordance with still another aspect of the present invention, the dock bridge includes a securing mechanism to secure the flexible material to each dock structure. The securing mechanism includes, but is not limited to, adhesives, nails, screws, bolts, tacks, staples, hook and loop fasteners, clamps, tongue and groove fasteners, and the like. In one preferred embodiment, the flexible material is secured to the adjacently positioned dock structures by nails and/or screws. In such an embodiment, the flexible material preferably includes reinforced regions about the nail or screw to resist or prevent the tearing of the flexible material about the nail or screw. The reinforcement may include, but is not limited to, washers, gaskets, hollow tubes, metal strips, and the like.

In accordance with yet another aspect of the present invention, the dock bridge includes a connector plate that is secure to one end of the flexible material. Preferably, the connector plate is connected to each of the two ends of the flexible material. The connector plate is preferably made of a material which is corrosion resistant and/or water resistant. The connector plate is preferably designed to be a less flexible structure than the flexible material which is connected thereto. In one preferred embodiment, the connector plate is made of plastic, hard rubber, wood, and/or metal. Preferably, the connector plate is made up of a corrosion resistant metal such as stainless steel, copper, and or a metal coated with a corrosion resistant material. In another preferred embodiment, the flexible material is connected to the connector plate by a mechanical connector which includes, but is not limited to, nails, screws, bolts, tacks, clamps, tongue and grove connectors, thread, loop and hook fasteners, and the like. In yet another preferred embodiment, the flexible material is connected to the connector plate by use of an adhesive, and/or at least partially molding the flexible material about at least one portion of the connector plate. Preferably, the flexible material is molded completely about the top and bottom surface of the end of the connector plate.

In accordance with a further aspect of the present invention, the flexible material of the dock bridge includes one or more ridges, ribs or groves on the surface of the flexible material. The ribs perform several functions, which include, but are not limited to, providing a gripping surface for an individual walking across the dock bridge structure, creating channels for water and other liquids to be rapidly channeled off the dock bridge to minimize slippage on the dock bridge, maintaining the desired flexibility of the flexible material, controlling the manner in which the flexible material flexes, and/or increasing the structural integrity of the flexible material. In one preferred embodiment, the flexible material includes a plurality of ribs creating multiple channels in the flexible material. In another preferred embodiment, ribs are positioned on both the top and bottom side of the flexible material to increase the flexibility of the flexible material. In still another preferred embodiment, the plurality of ribs are positioned so as to be substantially parallel with respect to one another and/or substantially evenly spaced from one another. In still a further preferred embodiment, the ribs are positioned substantially parallel to the longitudinal axis of the dock bridge so as to enhance the flexibility of the flexible material when the dock bridge is positioned between two or more adjacently positioned dock structures.

In accordance with another aspect of the present invention, the dock bridge includes a connector plate which includes one or more markings and/or openings. In one preferred embodiment, the connector plate includes a plurality of openings so that a nail, screw or the like is positioned into the opening and into the dock structure thereby securing the connector plate to the dock structure. In another preferred embodiment, the connector plate includes one or more physical and/or visual markings (i.e. color mark, an indent, pin hole, etc.) to indicate a location wherein the dock connector can be connected to the dock structure.

In accordance with yet another aspect of the present invention, at least one connector plate includes a bent or bracketed end which is designed to be secured on the side and/or underside of the decking boards on the top of the dock structure. The bent or bracketed design of the connector plate secures the connector plates to the decking boards on the side and/or underside surface of the dock structure thereby facilitating in securing the dock bridge to the dock structure. Preferably, the connector plate, in addition to the bracketed structure, is secured to the dock structure by additional mechanical connecting arrangements such as, but not limited to, nails, screws, tacks or the like.

In accordance with a further aspect of the present invention, the dock bridge covers the full width and at least a majority of the length of the gap between two adjacent dock structures. In one preferred embodiment, the dock bridge covers the full width and length of the gap.

The principle object of the present invention is to provide a dock bridge which overlies the gap between two adjacently positioned dock structures.

Another object of the present invention is to provide a dock bridge which is connected between two adjacently positioned dock structures and which is of a sturdy and secure character.

Still another object of the present invention is to provide a dock bridge which is water and/or corrosion resistant.

A further object of the present invention is to provide a dock bridge which includes flexible components which flex as the adjacently positioned dock structures move in relation to one another.

Still yet another object of the present invention is to provide a dock bridge which covers the gap between two adjacently positioned dock structures and provides an attractive appearing bridge between such dock structures.

Another object of the present invention is to provide a dock bridge which provides gripping surfaces to help insure slipping does not occur as a person passes over the dock bridge.

Still another object of the present invention is to provide a dock bridge which channels liquids off the dock structure.

A further object of the present invention is to provide a dock bridge which can be easily and securely connected to adjacently positioned dock structures.

Still another object of the present invention is to provide a dock bridge that covers the width and at least the majority of the length of a gap between two adjacent dock structures.

A further object of the present invention is to provide a dock bridge that can be attached to a wide variety of dock systems.

It is still yet a further object of the present invention to provide a dock bridge which economically and efficiently overcomes the problems associated with gaps between adjacently positioned dock structures.

These objects and other features of the present invention will become apparent to those skilled in the art from a reading and understanding of the following detailed description of the specification taken together with the accompanied drawings.

BRIEF DESCRIPTION OF THE DRAWINGS

The invention may take physical form in certain parts and arrangements of parts, the preferred embodiment which will be described in detail and illustrated in the accompanied drawings which form a part hereof and wherein.

DETAILED DESCRIPTION OF THE PREFERRED EMBODIMENT

Figure 1:
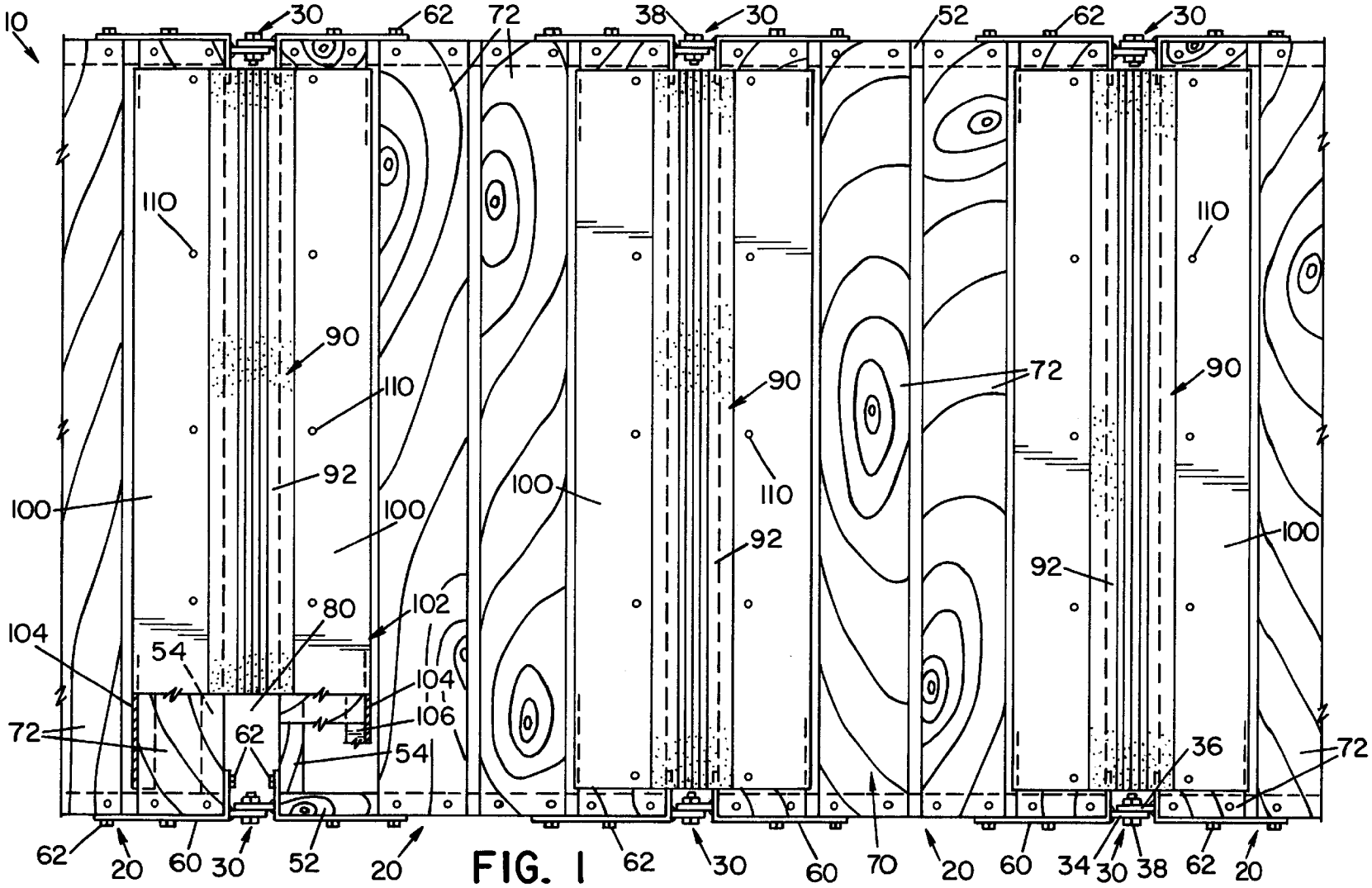
FIG. 1 is a top plan view of a dock structure that includes a dock bridge in accordance with the present invention.
Figure 2:
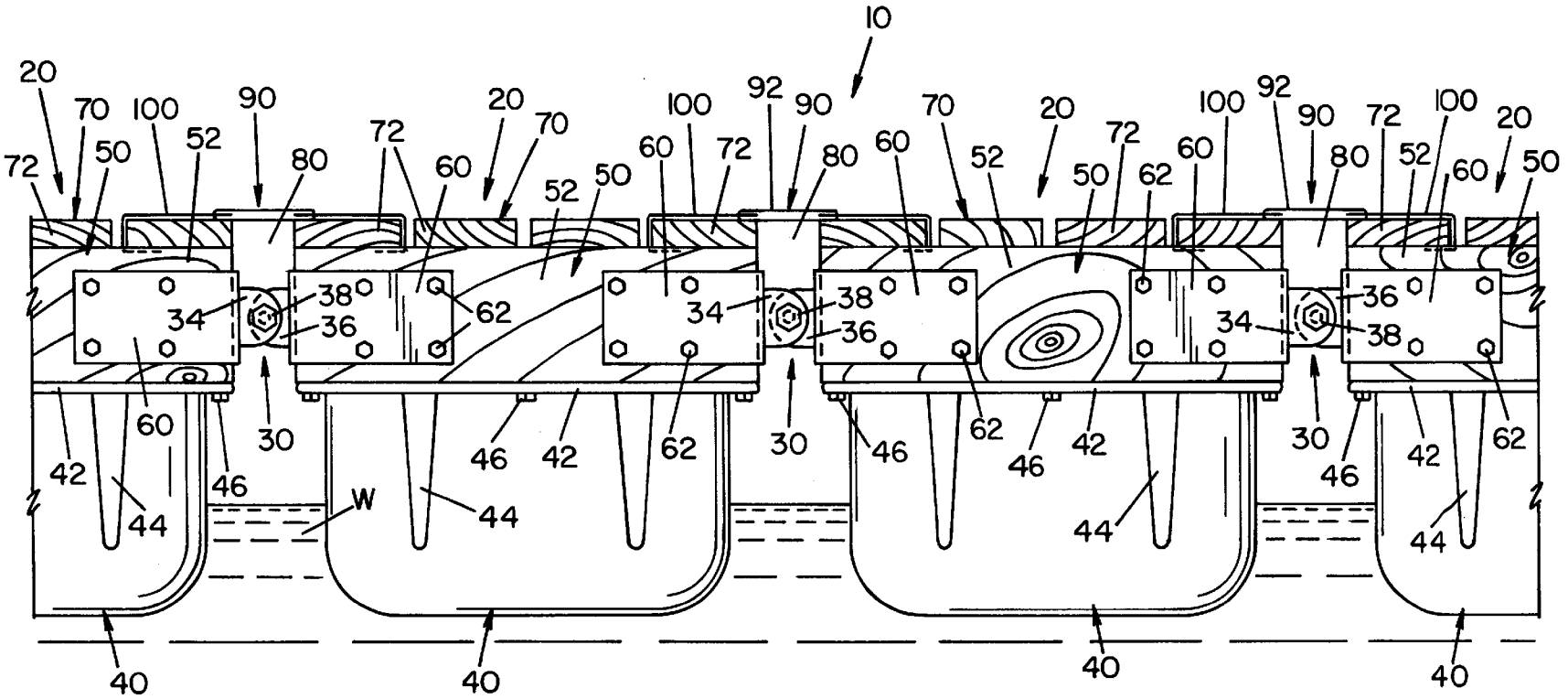
FIG. 2 is a side elevation view of a dock system which includes a dock bridge in accordance with the present invention.
Figure 2A:
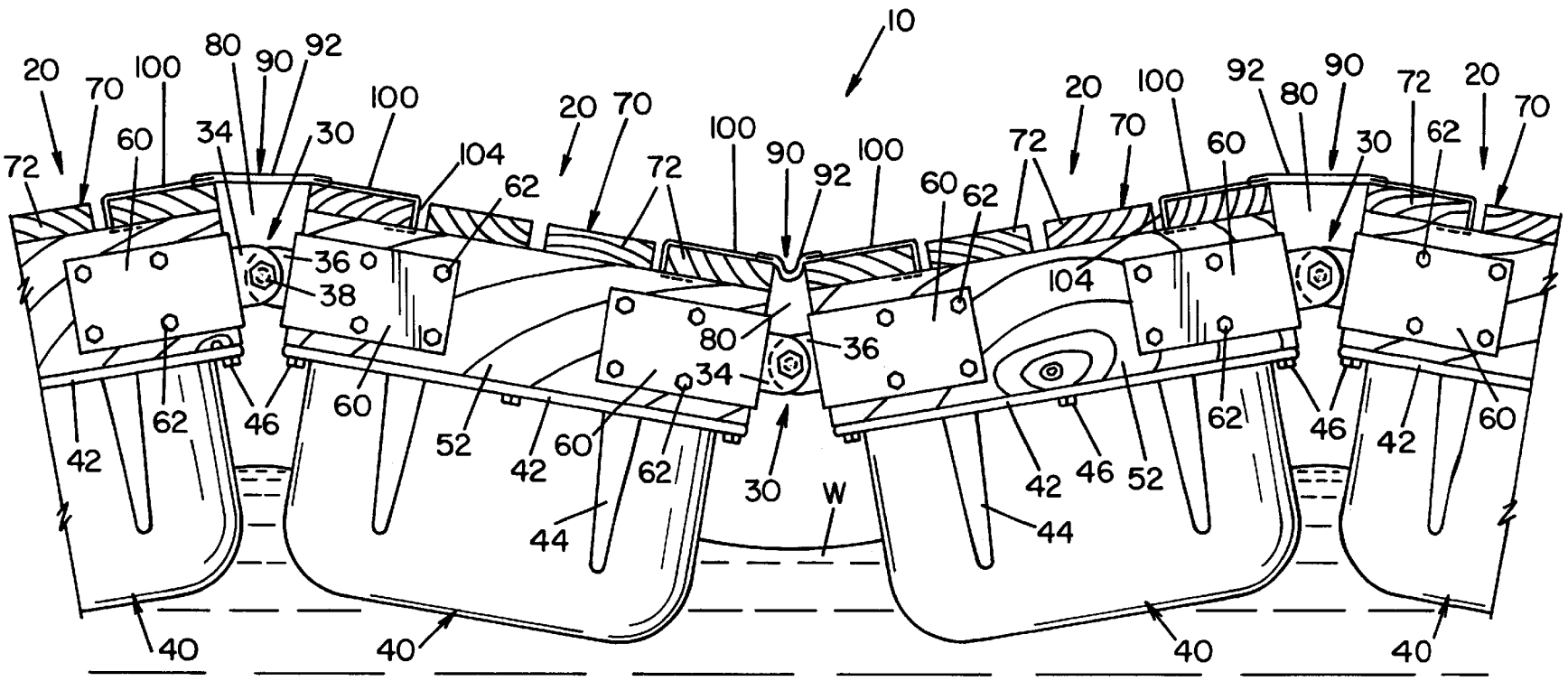
FIG. 2A is a side elevation view of a dock system in accordance with the present invention wherein the dock system is positioned in a turbulent environment.

Referring now to the drawings wherein the showings are for the purpose of illustrating a preferred embodiment of the invention only, and not for the purpose of limiting same, FIG. 1 illustrates a floating dock system which includes a plurality of individual dock sections 20 that are hingedly connected in an adjoining space relation to one another by a hinge 30 to permit vertical pivoting movement between the connected dock sections 20. As illustrated in FIGS. 2 and 2A, the individual dock sections 20 are each provided at there underside with a conventional float drum 40 that is secured to the underside of the dock section.

The float drum may be any conventional float drum which can provide the desired buoyancy to the particular dock structure for dock section 20. Preferably, the float drum is made of a corrosion resistant and puncture resistant material such as plastic and/or corrosion resistant metals. The float drum can include a mechanism to adjust the buoyancy of the float drum to obtain the desired buoyancy for a particular dock section. Preferably, the float drum includes a configured top wall portion terminating in a circumscribing top flange and a configured hollow bottom wall portion terminating in a circumscribing bottom flange. The top and bottom flanges 42 are intricately sealed together so that the top and bottom portion define an enclosure having a predetermined configuration. The float drum can be blow molded to form a single piece unit or be configured with a separate top wall portion and a bottom wall portion which are subsequently sealed together. The interior of a float drum may be filled with a variety of floatation materials which partially or completely fill the interior of the float drum 40. These materials include inflatable bladders, polystyrene core materials, polyurethane core materials, various types of liquids and gases and the like. The side walls and end walls of the float drum 40 include at least one flange supporting rib 44 which interrupts the flatness of the side and end walls. The flange supporting rib 44 provides additional structural integrity to the float drum. The support rib 44 has a shape of a semi-circular truncated cone with the larger diameter portion adjacent to the bottom side of flange 42 and smaller diameter portion semi-adjacent to the bottom wall of the float drum 40. However, the support rib 44 may have many other shapes. Although not shown, the top portion of the float drum 40 may include one or more utility channels to accommodate various types of utility pipes and wires which are associated with the dock system. The float drum 40 may also include one or more indentations to provide additional structural support. In addition, the dock float drum may include a stabilizer to help reduce the movement of the float drum in a liquid medium. Float drums which are preferably suitable for incorporation into the present invention are disclosed in Meriwether U.S. Pat. No. 4,974,538; Meriwether U.S. Pat. No. 4,799,445; and U.S. patent application Ser. No. 09/092,882 filed Jun. 8, 1998 and Ser. No. 09/183,318 filed Oct. 30, 1998, all of which are incorporated herein by reference.

As shown in FIGS. 2 and 2A, float drums 40 are connected to wooden frame 50 by a plurality of screws 46. Screws 46 are designed to fasten the bottom sides of wooden frame 50 to the top side of top flange 42.

Figure 3:
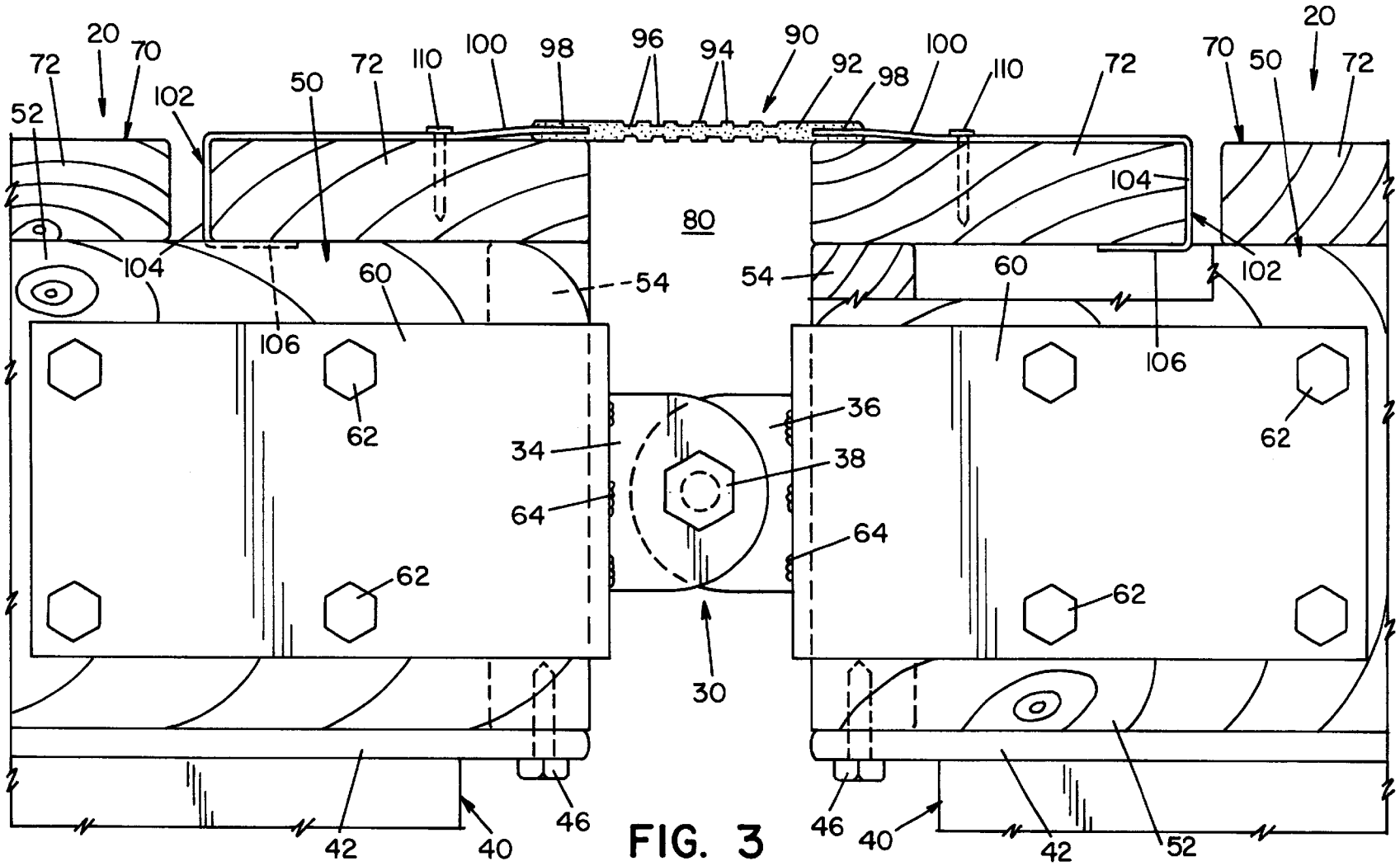
FIG. 3 is an enlarged sectional side view of the dock system of FIG. 2 illustrating a mechanism wherein two adjacent dock structures are connected together and wherein a dock bridge overlies a gap between the two dock sections.

By virtue of the hinge connection between the dock section 20 as illustrated in FIGS. 2, 2A and 3, the dock sections 20 are free to undergo vertical pivotal movement relative to one another as imparted thereon by the momentary surface wave conditions of the body of water W on which the dock sections float. FIG. 2 illustrates the dock sections in relatively calm water and FIG. 2A illustrates the dock sections in more turbulent water.

The dock sections 20 may be of any suitable platform like construction. Each dock section 20 includes a front beam member 54 designed to be hingably connected together in opposed facing, parallel and closely spaced relations to one another. In the case of the floating dock illustrated in FIGS. 1, 2, 2A, and 3, the dock sections 20 shown each comprise of a rectangular shape wooden frame 50 formed from a pair of elongated parallel extending, side beam members 52 suitably connected together at their ends to front beam members 54 by corner brackets 60. Corner brackets 60 are preferably made up of a corrosion resistant material such as a hard plastic, corrosion resistant metal, corrosion resistant treated metal or the like. The corner brackets 60 are connected to side and front beam members 52, 54 by bracket bolts 62. The beam members 52, 54 may be suitably formed of 2"×8" wood beams, for instance. However, the beams may have other dimensions and/or be made of materials such as aluminum, galvanized steel, plastic, and the like. Dock sections 20, as defined by the rectangular wooden frame 50, may have represented dimensions of ten feet in length and around four feet in width. However, the dock sections may have substantially longer and wider dimensions and/or may have shapes other than a rectangular shape.

Dock sections 20 are provided with a flat top decking 70 substantially formed of a plurality of deck boards 72, such as 2"×6" treated wood planks secured, by wood screws or dock nails, to the top of wooden frame 50. Deck boards 72 may have other dimensions and/or be made of other materials such as plastic, metal and the like. The deck boards are preferably positioned in a side by side relation extending transversely thereacross so as to lie in a common horizontal plane when the dock sections 20 are floating and at rest on a quiescent body of water. Deck boards 72 preferably are of a length matching the width of the wooden frame 50 so as to be coterminous thereof; however, the deck boards 72 may have other lengths and widths and may be arranged in other manners on the frame so as to provide various types of designs and configurations.

The float drums 40, as indicated above, are secured to the underside of wooden frame 50 and are each provided there around with an outwardly extending circumferential flange 42 having apertures for receiving screws 46 which secure the flanges 42 to the underside of wooden frame 50. The number of float drums 40 employed to float each dock section 20 will, of course, depend on the overall size of the respective dock section and the maximum load to which it is to be subjected in normal use. For most cases involving dock sections, for example, 10 feet in length and around 38 feet in width, two conventional type float drums, dimensions of approximately 36 inches in length, and 24 inches in width and 11 inches in height, which are positioned at opposite ends of the respective dock section 20 generally suffice for most purposes.

Hinge 30 which pivotally interconnects dock sections 20 together to form a floating dock system 10 includes a metal hinge 30 formed from a pair of identical metal hinge leafs 34, 36 which are connected together by a pivot bolt 38. Hinge 30 is preferably made of a corrosion resistant metal. Hinge 30 is connected to corner bracket 60 by conventional means such as a weld, bolts, screws and the like. As best illustrated in FIG. 3, hinge leafs 34, 36 are secured to corner bracket 60 by weld 64. As shown in FIGS. 2, 2A and 3, hinge 30 forms a gap 80 between two adjacently positioned dock sections 20. Gap 80 exists between float drums 40, wooden frame 50, and decking 70.

Figure 4:
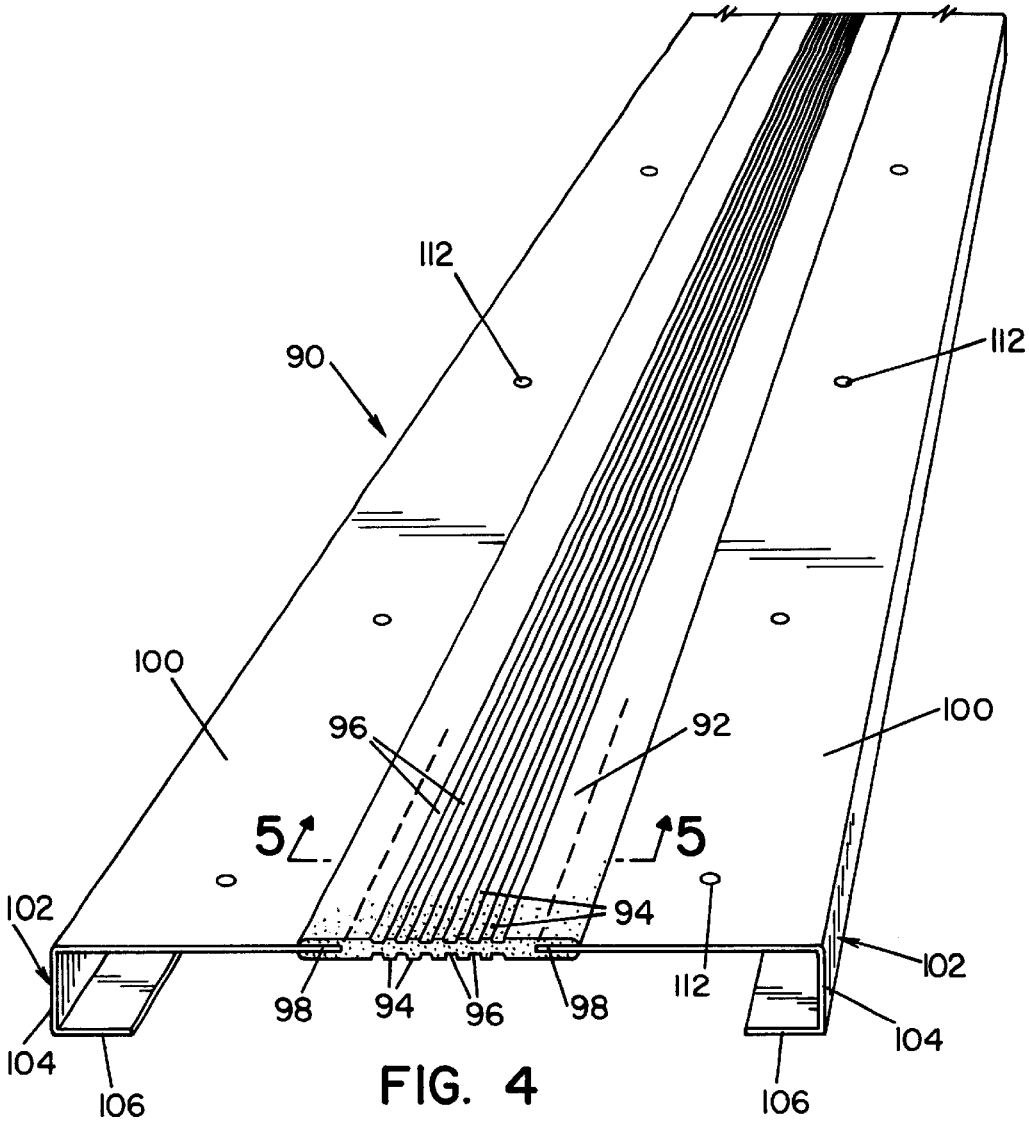
FIG. 4 is a perspective view of the dock bridge in accordance with the present invention.
Figure 5:
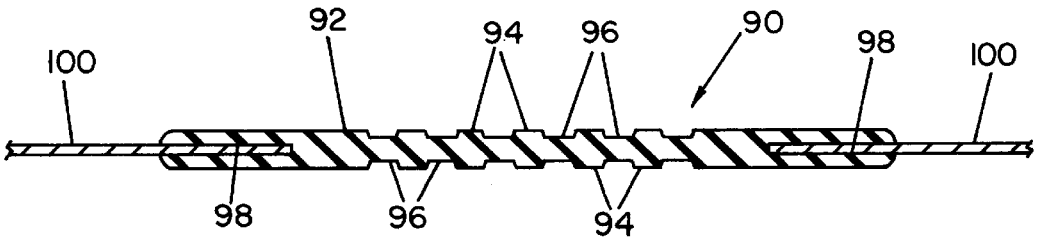
FIG. 5 is a cross sectional view along line 5—5 of FIG. 4.

As shown in FIGS. 1, 2, 2A, 3, and 6, dock bridge 90 is secured to the top of decking 70 thereby covering gap 80. As best shown in FIGS. 4 and 5, dock bridge 90 includes a flexible material 92 and two connector plates 100 connected thereto. Flexible material 92 is preferably made of a water resistant rubber material; however, other materials maybe used. Flexible material 92 includes a plurality of ribs 94. Ribs 94 provide a gripping surface for an individual walking across the dock bridge. Channels 96 provide for drainage so as to rapidly remove water present on the dock bridge 90. Ribs 94 and channels 96 are oriented in a substantially parallel relation to each other along the length of the dock bridge. The ribs 94 and channels 96 are positioned to lie substantially parallel to gap 80 to provide for the flexibility of flexible material 92.

Connector plate 100 is positioned in the plate gap 98. Connector plate 100 is connected to flexible material 92 by any conventional means such as adhesive molding or the like. Preferably, flexible material 92 is molded on connector plate 100 about the two sides of the connector plate 100. Connector plate 100 is made of a corrosion resistant material such as a plastic or metal material. Preferably, connector plate 100 includes a plurality of markers 112 to indicate where a bolt, nail, screw or the like maybe inserted into the connector plate 100 to secure the connector plate to decking 70. Markers 112 may constitute a small opening, a color indicator and/or indented region.

Figure 6:
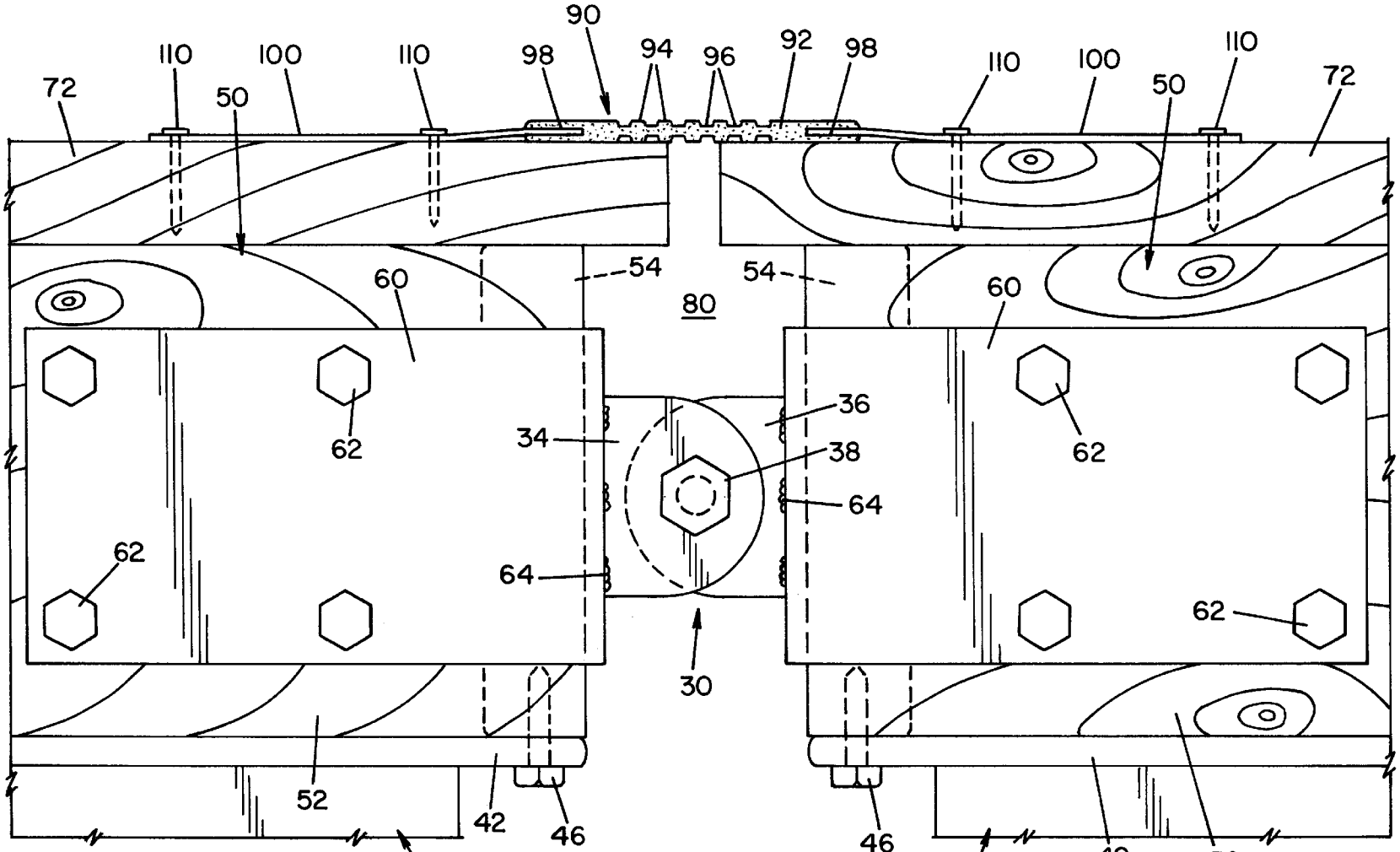
FIG. 6 is an enlarged sectional view of the side of a dock system illustrating an alternative embodiment of the dock bridge in accordance with the present invention.

Referring now to FIGS. 3 and 6, dock bridge 90 is secured to dock sections 20 by inserting a nail 110 or screw 46 through connector plate 100 and into the top of deck boards 72. When connector plate 100 is secured to decking 70, dock bridge 90 is arranged so as to insure that flexible material 92 is positioned over gap 80. As shown in FIGS. 2, 2A, 3, and 4, connector plate 100 includes a bracket 102 having a bracket side 104 and a bracket base 106 that is positioned about the side and underside of deck board 72 to further secure dock bridge 90 to dock sections 20. In an alternative embodiment as illustrated in FIG. 6, connector plate 100 does not include a bracket. The end of connector plate 100 is secured to the top of the decking 70 by nail 110 or screw 46.

As shown in FIG. 2A, flexible material 92 stretches and bends as adjacently positioned dock sections 20 pivot upwardly. The stretching and bending ability of the flexible material insures that the gap 80 is continuously covered as the dock sections 20 move with respect to one another.

The invention has been described with reference to a preferred embodiment and alternates thereof. It is believed that many modifications and alterations to the embodiments disclosed will readily suggest itself to those skilled in the art upon reading and understanding the detailed description of the invention. It is intended to include all such modifications and alterations in so far as they come within the scope of the present invention.

Having thus defined my invention, I claim:

1. In a dock having at least first and second floating sections, each of said sections having a top surface and at least one end surface forming a side edge with said top surface, said floating sections being arranged so that an end surface of one section confronts an end surface of an adjacent section with a gap between the end surfaces; the improvement comprising: a hinged connection between adjacent end surfaces permitting relative pivotal movement of adjacent sections, while tying the adjacent sections together and a dock bridge extending across said gap between and supported by said top surfaces of said first and second floating sections, said dock bridge including a flexible material extending between said top surfaces of said first and second floating sections, and anchored to at least one of said floating sections.

2. The improvement as defined in claim 1, wherein said flexible material is a water-resistant material at least partially made of rubber.

3. The improvement as defined in claim 2, wherein said flexible material includes at least one rib.

4. The improvement as defined in claim 3, wherein said dock bridge includes at least one connector plate secured to an end of said flexible material, said connector plate being less flexible than said flexible material.

5. The improvement as defined in claim 4, wherein said at least one connector plate is made of a corrosion resistant metal.

6. The improvement as defined in claim 5, including two connector plates.

7. The improvement as defined in claim 6, wherein each of said two connector plates includes a top surface, a bottom surface, and at least two edges, said flexible material being molded along at least one of said at least two edges of each of said two connector plates, and extending over at least a portion of at least one of said surfaces of each of said two connector plates.

8. The improvement as defined in claim 7, wherein at least one of said two connector plates include at least one bracketed end to secure to one of said first or second dock sections.

9. The improvement as defined in claim 2, wherein said dock bridge includes at least one connector plate having a top surface, a bottom surface, and at least two edges, said flexible material being molded along at least one of said at least two edges of said at least one connector plate, and extending over at least a portion of at least one of said surfaces.

10. The improvement as defined in claim 9, where said at least one connector plate includes at least one bracketed end to secure to said first dock section.

11. The improvement as defined in claim 1, wherein said flexible material includes at least one rib.

12. The improvement as defined in claim 11, wherein said dock bridge includes at least one connector plate secured to an end of said flexible material, said connector plate being less flexible than said flexible material.

13. The improvement as defined in claim 1, wherein said dock bridge includes at least one connector plate secured to an end of said flexible material, said connector plate being less flexible than said flexible material.

14. The improvement as defined in claim 13, wherein said at least one connector plate is made of a corrosion resistant metal.

15. The improvement as defined in claim 13, including two connector plates.

16. The improvement as defined in claim 15, wherein each of said two connector plates includes a top surface, a bottom surface, and at least two edges, said flexible material being molded along at least one of said at least two edges of each of said two connector plates, extending over at least a portion of at least one of said surfaces of each of said two connector plates.

17. The improvement as defined in claim 13, wherein said at least one connecting plate includes a top surface, a bottom surface, and at least two edges, said flexible material being molded along at least one of said at least two edges of said at least one connector plate, and extending over at least a portion of at least one of said surfaces.

18. The improvement as defined in claim 13, where said at least one connector plate includes at least one bracketed end to secure to said first dock section.

19. The improvement as defined in claim 13, where in said at least one connector plate includes at least one securing opening.

20. The improvement as defined in claim 1, wherein said dock bridge includes at least one connector plate, having a top surface, a bottom surface, and at least two edges, said flexible material being molded along at least one of said at least two edges of said at least one connector plate, and extending over at least a portion of at least one of said surfaces.

21. The improvement of claim 1, wherein said dock includes a plurality of connected dock sections extending end to end in a generally longitudinal direction and said flexible material of said dock bridge having a plurality of generally parallel ribs extending in a generally transverse direction to said dock bridge whereby the dock bridge can flex with the vertical movement of the dock sections while maintaining a generally rigid support spanning the gap.

22. The improvement of claim 21, wherein the hinge is situated beneath the top surface of adjacent dock sections.

* * * * *